US009114646B2

(12) United States Patent
Ishimori et al.

(10) Patent No.: US 9,114,646 B2
(45) Date of Patent: Aug. 25, 2015

(54) PRINTING DEVICE AND RECORDING PAPER CONVEYANCE MECHANISM

(75) Inventors: Hiroyuki Ishimori, Matsumoto (JP); Takashi Aoki, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 227 days.

(21) Appl. No.: 13/537,428

(22) Filed: Jun. 29, 2012

(65) Prior Publication Data

US 2013/0050375 A1 Feb. 28, 2013

(30) Foreign Application Priority Data

Aug. 23, 2011 (JP) ..... 2011-181292

(51) Int. Cl.
*B41J 2/01* (2006.01)
*B41J 11/06* (2006.01)
*B41J 11/00* (2006.01)

(52) U.S. Cl.
CPC ..... *B41J 11/06* (2013.01); *B41J 11/0085* (2013.01)

(58) Field of Classification Search
CPC ..... B41J 11/007; B41J 11/06; B41J 11/0085; B41J 13/103; B41J 11/0065; B41J 2/2114
See application file for complete search history.

(56) References Cited

U.S. PATENT DOCUMENTS 6,981,766 B2 * 1/2006 Tsuji ..... 347/104
8,152,296 B2 4/2012 Maekawa et al.
2002/0126191 A1 * 9/2002 Fujioka ..... 347/104
2004/0169712 A1 9/2004 Tsuji
2006/0071998 A1 4/2006 Kruijt
2009/0244247 A1 * 10/2009 Yamamoto et al. ..... 347/104
2010/0118098 A1 5/2010 Ebihara
2010/0171804 A1 7/2010 Takahashi et al.
2011/0057380 A1 3/2011 Maeyama et al.
2011/0157288 A1 * 6/2011 Morimoto et al. ..... 347/104
2012/0218341 A1 * 8/2012 Maekawa et al. ..... 347/20

FOREIGN PATENT DOCUMENTS

EP 1223042 A1 7/2002
EP 1449668 A1 8/2004
JP 2001-316011 A 11/2001
JP 2002-205855 A 7/2002
JP 2005138305 A 6/2005
JP 2009053408 A 3/2009

(Continued)

OTHER PUBLICATIONS

Extended European Search Report corresponding to EP 12181003.0, dated Dec. 4, 2012.

*Primary Examiner* — Manish S Shah
*Assistant Examiner* — Jeremy Delozier
(74) *Attorney, Agent, or Firm* — Lowe Hauptman & Ham, LLP

(57) ABSTRACT

A printing device has a liquid droplet ejection head that ejects liquid droplets; a conveyance unit that conveys recording paper; a platen that is disposed opposite the liquid droplet ejection head and has a plurality of suction holes arrayed in the conveyance direction in which the conveyance unit conveys the recording paper and a lateral direction perpendicular to the conveyance direction; a suction mechanism unit that suctions the recording paper through the suction holes in the platen; and an opening/closing mechanism that opens or closes at least part of the plural suction holes.

22 Claims, 8 Drawing Sheets

(56) References Cited

FOREIGN PATENT DOCUMENTS

| | | | |
|---|---|---|---|
| JP | 2010083035 | A | 4/2010 |
| JP | 2010094870 | A | 4/2010 |
| JP | 4549025 | B2 | 9/2010 |
| JP | 2010201683 | A | 9/2010 |
| JP | 2011056694 | A | 3/2011 |
| JP | 2011-136509 | A | 7/2011 |

* cited by examiner

PRINTING DEVICE AND RECORDING PAPER CONVEYANCE MECHANISM

BACKGROUND

1. Technical Field

The present invention relates to a printing device and a recording paper conveyance mechanism.

2. Related Art

Holding recording paper to the platen surface that defines the printing position to the recording paper and thereby maintaining a highly precise platen gap is important in order to maintain good print quality in printers that print on recording paper by ejecting ink droplets from an ink ejection head. A suction platen that holds the recording paper to the platen surface by air suction while the paper is conveyed can be used to convey the recording paper while holding it tight to the platen surface. However, if the suction pressure is low, the recording paper may lift away from the platen surface and print quality drop, or the recording paper could rub against the ink ejection head and become soiled with ink.

To address this problem, Japanese Unexamined Patent Appl. Pub. JP-A-2010-201683 describes a printer having a first suction area that is divided into a grid and disposed substantially in the center of the platen width perpendicular to the recording paper conveyance direction with first suction holes formed in the bottom of each chamber of the grid in this first suction area, and second suction areas formed on opposite sides of the first suction area with second suction holes with a different arrangement or shape than the first suction holes in the first suction area. Relatively narrow recording paper is suctioned to the platen using the first suction area, and wide recording paper is suctioned to the platen using both the first suction area and second suction areas.

Japanese Unexamined Patent Appl. Pub. JP-A-2011-56694 describes a printer having a plurality of suction holes formed in the platen in both the recording paper conveyance and width directions, air chambers facing the suction holes, and suction means that pull air through the air chambers. There are two or more air chambers in the recording paper conveyance direction and a direction intersecting the conveyance direction. One suction means is connected to at least one air chamber, and at least one suction means is connected to another air chamber, and the printer changes the duty of the suction means in the area where the recording paper covers the suction holes, and the duty of the suction means in the area where all suction holes are not covered.

A problem with both JP-A-2010-201683 and JP-A-2011-56694 is that sufficient suction pressure cannot be achieved when narrow recording paper is used because the suction holes outside of the recording paper are open, air is pulled therethrough, and suction pressure is therefore lost. More particularly, print quality drops when relatively stiff recording paper is used because the recording paper lifts away from the platen, or the recording paper rubs against the ink ejection head and becomes soiled with ink.

A problem with JP-A-2011-56694 is that providing a suction means to the air chambers to be suctioned and also providing a suction means to the other air chambers is structurally complicated, and control is also complicated by changing the duty of plural suction means.

SUMMARY

The present invention solves at least part of the foregoing problem and can be achieved as described below.

A printing device according to one aspect of the invention has a liquid droplet ejection head that ejects liquid droplets; a conveyance unit that conveys recording paper; a platen that is disposed opposite the liquid droplet ejection head and has a plurality of suction holes arrayed in a conveyance direction in which the conveyance unit conveys the recording paper and a lateral direction perpendicular to the conveyance direction; a suction mechanism unit that suctions the recording paper through the suction holes in the platen; and an opening/closing mechanism that opens or closes at least part of the plural suction holes.

Preferably, the opening/closing mechanism opens the suction holes disposed at a position covered by the recording paper, and closes the suction holes disposed at a position not covered by the recording paper.

Further preferably, the opening/closing mechanism opens the suction holes when the recording paper is conveyed by the conveyance unit and the suction holes are covered by the recording paper, and closes the suction holes when the recording paper is conveyed by the conveyance unit and the suction holes are no longer covered by the recording paper.

In this aspect of the invention the suction holes in the area where the suction holes are completely covered by the recording paper are opened by the opening/closing mechanism and the recording paper is pulled by suction to the platen surface. In the area not covered by the recording paper (that is, the area where some or all of the suction holes are exposed), the suction holes are closed by the opening/closing mechanism so that suction pressure on the recording paper is not produced.

As a result, when narrow recording paper or stiff recording paper is used, loss of suction pressure is reduced by suctioning the recording paper only through suction holes that are covered by the recording paper, and sufficient suction pressure can be achieved. A drop in print quality caused by the recording paper lifting away from the platen, and the recording paper becoming soiled by ink from the recording paper rubbing against the liquid droplet ejection head, can therefore be prevented.

Because opening and closing the suction holes is done with the opening/closing mechanism and the recording paper can be suctioned to the platen using a single suction mechanism unit, control can be simplified.

In addition, because the print area is in the area where the recording paper is suctioned to the platen, and there is no suction through suction holes that are not covered by the recording paper, dispersion of the ejected ink droplets is reduced and print quality can be maintained. This also has the effect of enabling reducing the margin at the edges of the recording paper width.

In a printing device according to another aspect of the invention, the opening/closing mechanism includes a first opening/closing unit that opens or closes the suction holes disposed on one side of the lateral direction in the plural suction holes, and a second opening/closing unit that opens or closes the suction holes disposed on one side of the conveyance direction in the plural suction holes.

Because the suction holes that are opened and closed by the first opening/closing unit are selected according to the width of the recording paper, the center of the recording paper width can be suctioned when narrow recording paper is used, suction can also be applied through suction holes at the outside width of the recording paper area when wide paper is used, and suction can be applied according to the paper width.

The second opening/closing unit can also open suction holes that are covered by the recording paper, and the recording paper can be suctioned, according to the conveyance position of the recording paper (including forward and reverse conveyance).

A printing device according to another aspect of the invention preferably also has an air chamber that communicates with a plurality of suction holes disposed in the conveyance direction; a path that connects the air chamber and the suction mechanism unit; and a valve that is disposed to and opens and closes the path.

Air chambers disposed for each row of suction holes arrayed in the conveyance direction as used herein means if plural suction holes arrayed in the conveyance direction are longitudinal rows of suction holes, there are plural longitudinal rows disposed across the lateral direction, and an air chamber is provided for each of these longitudinal rows.

The first opening/closing unit can therefore control the suction area according to the width of the recording paper.

Further preferably, the second opening/closing unit opens or closes the suction holes based on the conveyance position of the recording paper by the conveyance unit.

The second opening/closing unit can determine the suction area by lateral row according to recording paper conveyance.

Further preferably, the second opening/closing unit opens or closes the suction holes on the opposite side as the one side in the conveyance direction in the plural suction holes.

Further preferably, the second opening/closing unit has a first shutter plate that opens or closes suction holes disposed on one side in the conveyance direction, and a second shutter plate that opens or closes suction holes disposed on the other side in the conveyance direction.

Further preferably, the printing device also has a paper width detection unit that detects the width of the recording paper; and the first opening/closing unit opens or closes the suction holes based on the paper width detected by the paper width detection unit.

In another aspect of the invention, the first opening/closing unit opens or closes the suction holes on one side and the opposite other side of the paper width in the plural suction holes.

This aspect of the invention detects (measures) the width of the recording paper when the recording paper is conveyed over the platen and determines the suction holes to open and close according to the detected width, and can therefore easily determine the suction area in the lateral (width) direction according to the width of the recording paper.

Further preferably in a printing device according to another aspect of the invention, the second opening/closing unit opens or closes the suction holes based on a result calculated using a conveyance speed of the recording paper by the conveyance unit and a distance between the plural suction holes in the recording paper conveyance direction.

This aspect of the invention can determine the position of the recording paper relative to the suction holes, and thereby open and close the suction holes at appropriate times. Another advantage is that a sensor or other detection means for detecting the position of the leading end of the recording paper during conveyance is not required to adjust the open/close timing to the recording paper conveyance position.

Further preferably, a printing device according to another aspect of the invention also has a cam that drives the first shutter plate and the second shutter plate.

Further preferably, the cam phase is synchronized to the preset open or close timing of the suction holes.

Speed control of the conveyance speed and cam group drive is simple when separate motors are used as the drive source of each. Because the cam phase can therefore be structurally fixed, the open/close timing of the suction holes can also be controlled with high precision.

Another aspect of the invention is a recording paper conveyance mechanism including a platen that is disposed opposite a liquid droplet ejection head and has a plurality of suction holes arrayed in a conveyance direction of recording paper and a lateral direction perpendicular to the conveyance direction; a suction mechanism unit that suctions the recording paper through the suction holes in the platen; and an opening/closing mechanism that opens or closes at least part of the plural suction holes.

Preferably, the opening/closing mechanism opens the suction holes disposed at a position covered by the recording paper, and closes the suction holes disposed at a position not covered by the recording paper.

Further preferably, the opening/closing mechanism opens the suction holes when the recording paper is conveyed by the conveyance unit and the suction holes are covered by the recording paper, and closes the suction holes when the recording paper is conveyed by the conveyance unit and the suction holes are no longer covered by the recording paper.

Yet further preferably, the opening/closing mechanism includes a first opening/closing unit that opens or closes the suction holes disposed on one side of the lateral direction in the plural suction holes, and a second opening/closing unit that opens or closes the suction holes disposed on one side of the conveyance direction in the plural suction holes.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

The figures referenced in the following description show various parts in sizes enabling easy recognition, and the horizontal and vertical scale of the various members and parts may differ from the actual parts.

General Configuration

The printing device described in the following embodiment of the invention is a roll paper printer having a suction mechanism that holds the recording paper to the platen by suction.

Figure 1:
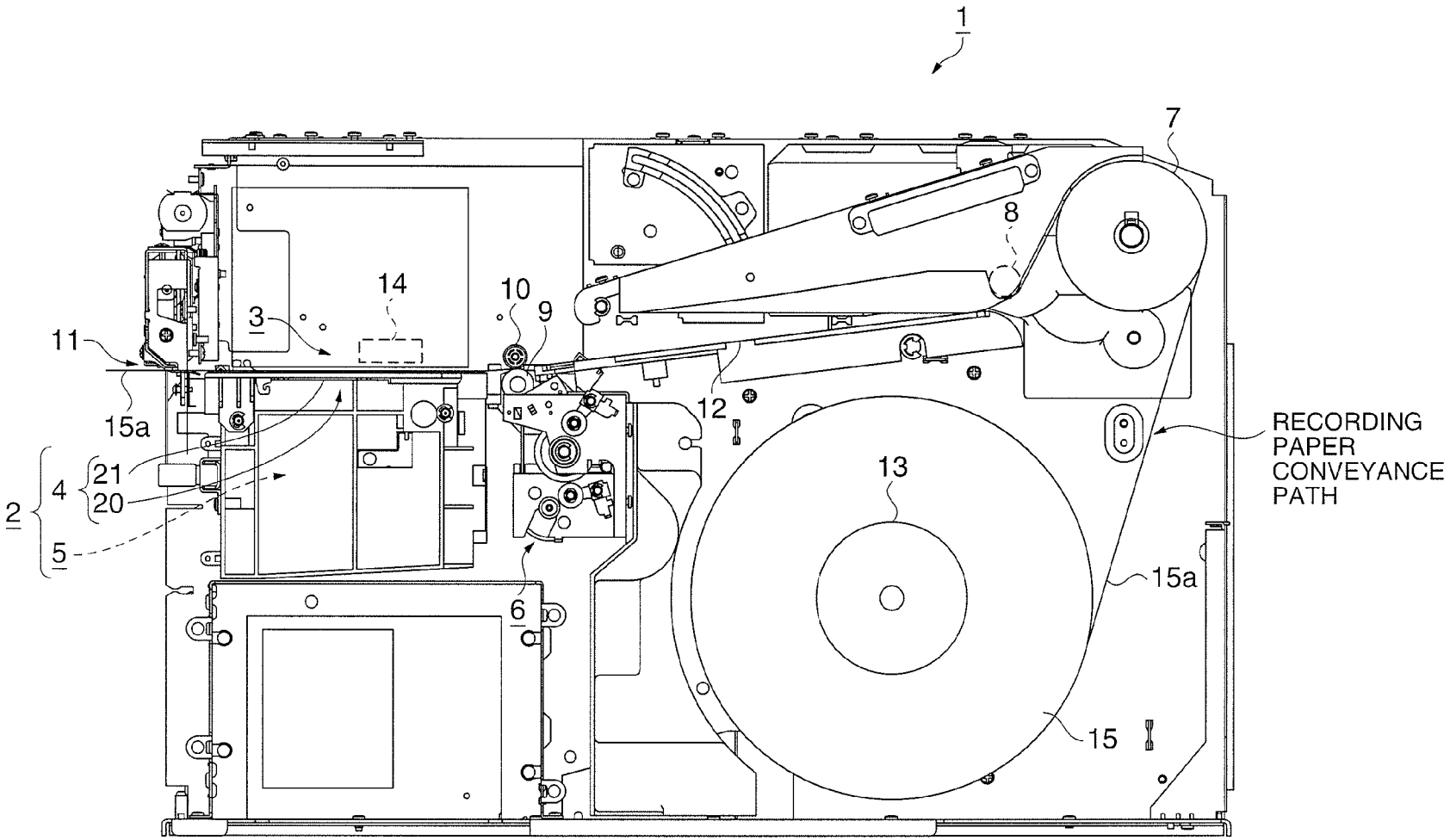
FIG. 1 shows the internal structure of a printer.

FIG. 1 shows the internal configuration of a printer according to this embodiment of the invention. The main parts of this printer 1 are a main printer unit and a roll paper conveyance unit.

The main printer unit includes a liquid droplet ejection head 3, a platen unit 2 including a platen 21 and opening/closing mechanism 20 disposed opposite the inkjet head 3 with the recording paper 15*a* therebetween, a suction unit 5 for suctioning the recording paper 15*a* to the platen surface through suction holes formed in the platen 21, and a paper width (PW) detection sensor 14 that moves with the inkjet head 3 and measures the width of the recording paper 15*a*.

The liquid droplet ejection head 3 in this embodiment is an inkjet head as known from the literature, and further description thereof is omitted.

Parts of the platen unit 2 are described in detail below with reference to FIG. 2 to FIG. 5.

The configuration of the recording paper conveyance unit is described next following the recording paper conveyance path.

The roll paper 15 is first set on a roll paper drive shaft 13. The roll paper 15 is then conveyed by a feed roller 7, guide roller 8, and paper feed drive unit 6, and discharged from a paper exit 11.

Note that below the print area of the roll paper 15 on the platen 21 is referred to and described as recording paper 15*a* below.

A roll paper shaft drive motor (not shown in the figure) is connected to the roll paper drive shaft 13, and is driven when rewinding the roll paper 15 (back-feeding or reverse conveyance).

The paper feed drive unit 6 includes a paper feed roller 9, a pressure roller 10 that presses the recording paper 15*a* to the paper feed roller 9, and a paper feed motor (not shown in the figure) that rotationally drives the paper feed roller 9. Note that the pressure roller 10 separates from the paper feed roller 9 when rewinding the roll paper 15.

An encoder (not shown in the figure) is also disposed to the paper feed drive unit 6 and roll paper drive shaft 13 (or the drive motors thereof). The conveyance speed and distance of the recording paper 15*a* is detected using output from the encoder. The encoder on the paper feed drive unit 6 is used to detect the conveyance speed and conveyance distance during forward conveyance, and the encoder on the roll paper drive shaft 13 is used during reverse conveyance.

A roll paper guide 12 is disposed between the guide roller 8 and paper feed roller 9. The roll paper guide 12 controls the widthwise position of the roll paper 15, and functions to keep the recording paper 15*a* substantially centered to the platen 21 width regardless of the width of the roll paper 15.

Platen Unit Configuration

The configuration of the platen unit 2 is described next.

Figure 2:
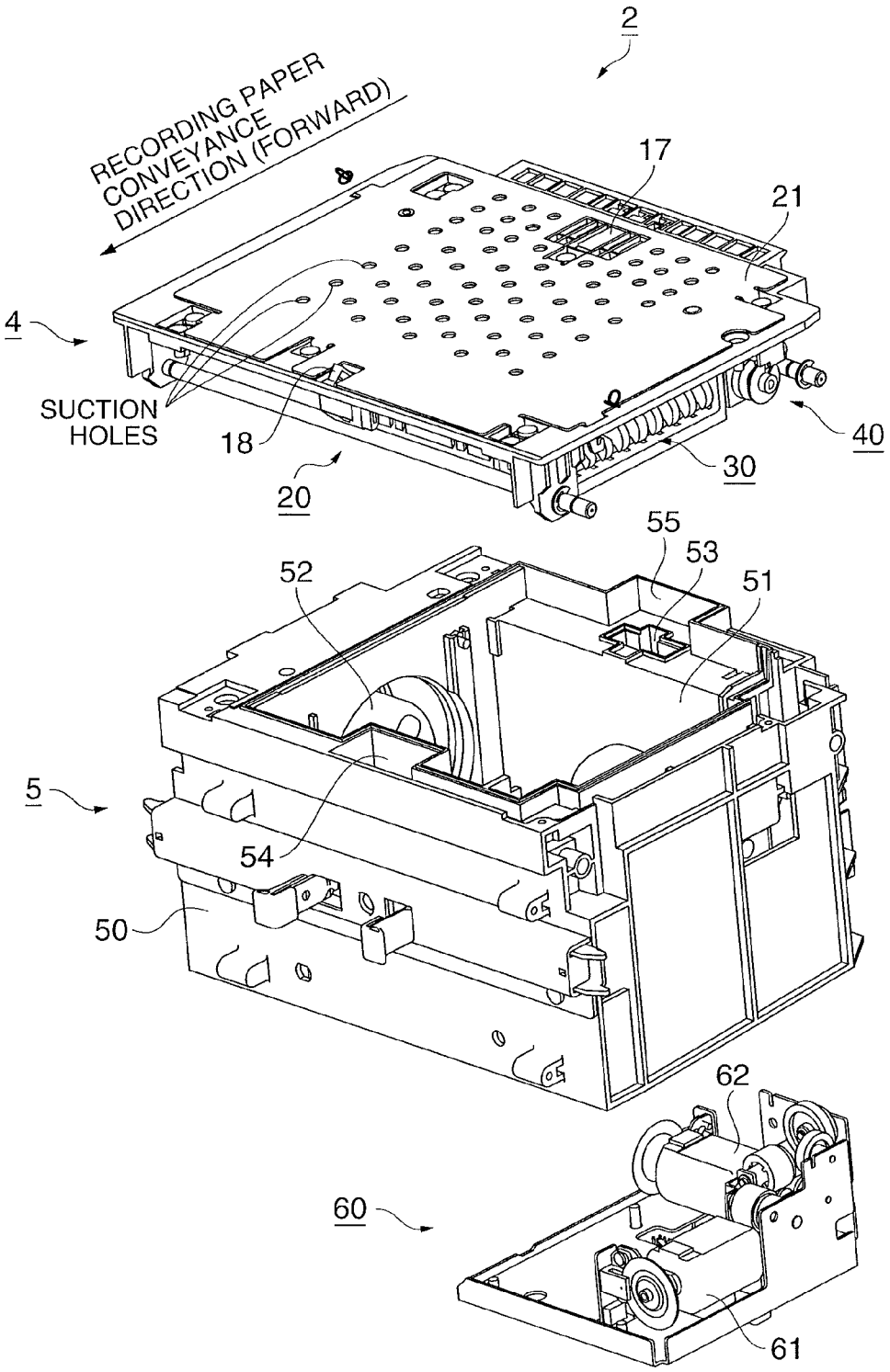
FIG. 2 is an exploded oblique view of the platen unit.

FIG. 2 is an exploded oblique view of the platen unit 2. The platen unit 2 has a platen mechanism unit 4 including the platen 21 and opening/closing mechanism 20, the suction unit 5, and an open/close drive unit 60.

The platen 21 is the top surface of the platen mechanism unit 4. A recording paper position detection sensor 17 that detects the start printing reference position of the recording paper 15*a* is disposed exposed from the platen surface at the upstream side (the side from which conveyance starts) of the recording paper conveyance direction (forward conveyance). A leading end position detection unit 18 that detects the position of the leading end of the recording paper is disposed exposed from the platen surface at the downstream end in the recording paper conveyance direction.

A first cam group 30 that drives a paper feed (PF) shutter plate (see FIG. 4) to slide in the recording paper conveyance direction, and a second cam group 40 perpendicular to the first cam group 30 that causes a paper width (PW) shutter plate (FIG. 4) to rock, are disposed on the back side of the platen 21. The PF shutter plate and the first cam group 30, and the PW shutter plate and the second cam group 40, are housed in the space (suction chamber 51) inside the suction unit 5.

The suction unit 5 has a suction chamber 51 inside a case 50, and a suction fan 52 that discharges air inside the suction chamber 51 to the outside. A sensor housing 53 that houses the recording paper position detection sensor 17, and a sensor housing 54 that houses the leading end position detection unit 18, are formed in the top edge part of the case 50. The open/close drive unit 60 is housed inside the suction chamber 51 of the suction unit 5.

The open/close drive unit 60 includes a motor 61 that rotationally drives the first cam group 30, and a motor 62 that rotationally drives the second cam group 40.

A plurality of suction holes are formed in a matrix pattern in the recording paper 15*a* conveyance direction and the paper width direction perpendicular to the conveyance direction. The arrangement of these suction holes is described with reference to FIG. 3.

Figure 3:
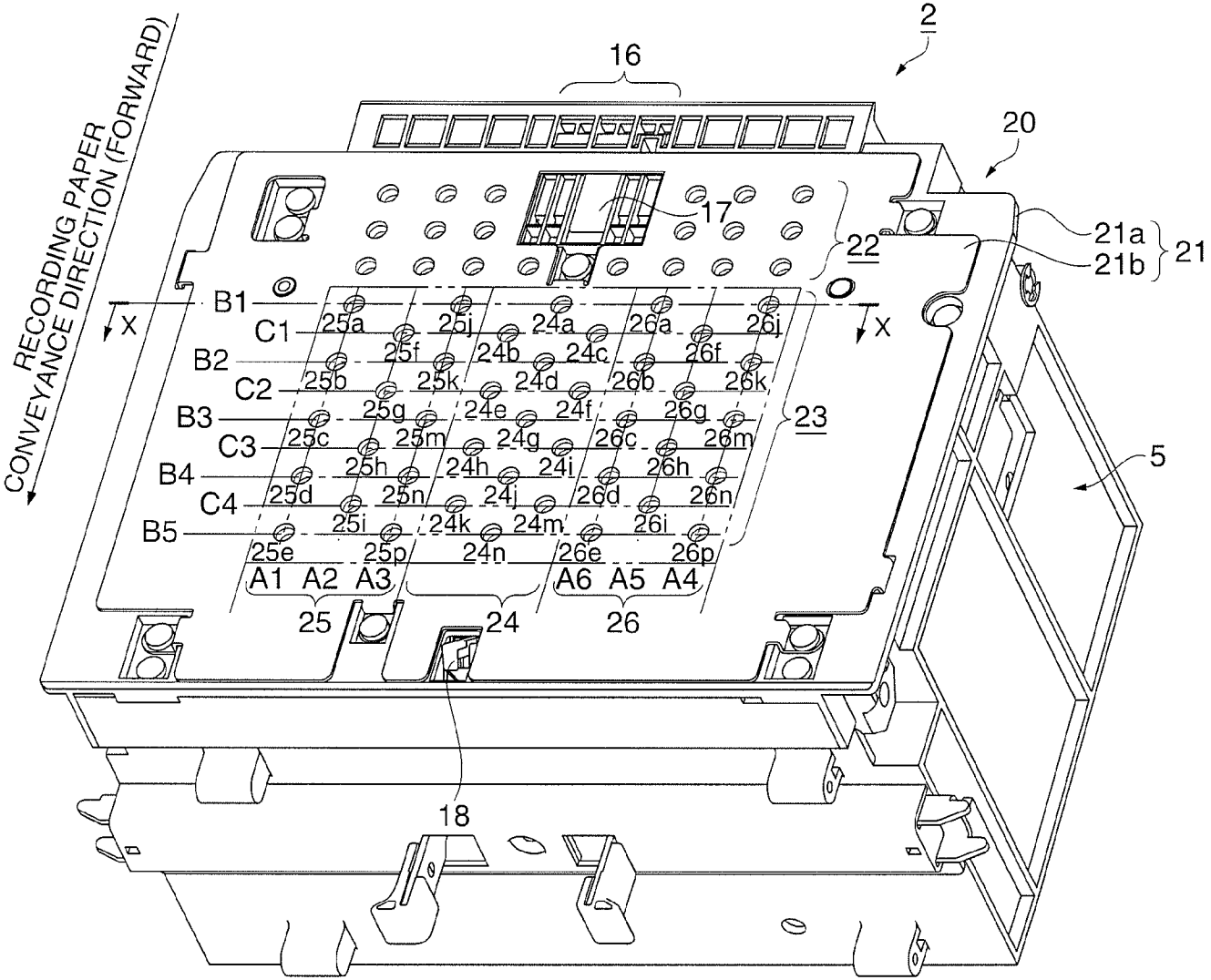
FIG. 3 shows the arrangement of suction holes in the platen.

FIG. 3 shows the arrangement of the suction holes formed in the platen. Note also that FIG. 3 shows the entire platen unit 2. The platen 21 includes a platen base 21*a* and platen top 21*b* stacked and fastened together, the plural suction holes pass through both, and the platen base 21*a* and platen top 21*b* are therefore referred to together as the platen 21 below.

The suction holes are divided into a suction area 22 on the upstream side in the recording paper conveyance direction (forward conveyance) and a suction area 23 on the downstream side in the forward conveyance direction. Suction area 22 is an area that does not open and close, and is used to provide suction until the recording paper 15*a* reaches the upstream position where detection by the recording paper position detection sensor 17 is possible. Suction area 23 is an area where suction holes are opened and closed while printing.

The suction holes are further grouped in the recording paper conveyance direction into a first suction area 24 open to the middle of the recording paper 15*a*, and a second suction area 25 and third suction area 26 open on opposite sides of the first suction area 24 in the paper width direction perpendicular to the recording paper conveyance direction. The rows of suction holes formed along the recording paper conveyance direction are referred to herein as longitudinal rows. As shown in FIG. 3, nine longitudinal rows of suction holes are formed across the width of the recording paper 15*a*.

Suction holes 24*a* to 24*n* are formed in the first suction area 24. In this embodiment the first suction area 24 are disposed in the area corresponding to the shortest width of recording paper 15*a* expected to be used.

In the second suction area 25, suction holes are formed in rows A1, A2, A3 from one side of the paper width to the center with suction holes 25*a*-25*e* formed in row A1, suction holes 25*f*-25*i* in row A2, and suction holes 25*j*-25*p* in row A3.

In the third suction area 26, suction holes are formed in rows A4, A5, A6 from the opposite side of the paper width toward the center with suction holes 26*j*-26*p* formed in row A4, suction holes 26*f*-26*i* in row A5, and suction holes 26*a*-26*e* in row A6.

The arrangement of the suction holes in lateral rows is described next. The suction holes are arranged in lateral rows as well as the longitudinal rows described above. Groups of plural suction holes arranged across the width of the recording paper 15*a* are referred to as lateral rows of suction holes, and nine lateral rows labelled rows B1 to B5 and rows C1 to C4 alternate in the conveyance direction as shown in the figure.

The arrangement of suction holes in these lateral rows includes suction holes 25*a*, 25*j*, 24*a*, 26*a*, 26*j* in row B1, suction holes 25*b*, 25*k*, 24*d*, 26*b*, 26*k* in row B2, suction holes 25*c*, 25*m*, 24*g*, 26*c*, 26*m* in row B3, suction holes 25*d*, 25*n*, 24*j*, 26*d*, 26*n* in row B4, and suction holes 25*e*, 25*p*, 24*n*, 26*e*, 26*p* in row B5.

Row C1 includes suction holes 25*f*, 24*b*, 24*c*, 26*f*, row C2 includes suction holes 25*g*, 24*e*, 24*f*, 26*g*, row C3 includes suction holes 25*h*, 24*h*, 24*i*, 26*h*, and row C4 includes suction holes 25*i*, 24*k*, 24*m*, 26*i*.

The suction holes are therefore arranged in a matrix of longitudinal and lateral rows as shown in FIG. 3. The second suction area 25 of longitudinal rows A1, A2, A3, and the third suction area 26 of longitudinal rows A4, A5, A6, communicate with or are closed to the air chamber (see FIG. 5) by the PW shutter plates 101 to 106 (see FIG. 4) as described below.

The lateral rows B1, B2, B3, B4, B5 are opened and closed by a first PF shutter plate group 70 described below, and lateral rows C1, C2, C3, C4 are opened and closed by a second PF shutter plate group 80.

A black mark sensor 16 is disposed to the upstream side of the platen 21 in the recording paper 15*a* conveyance direction. When roll paper having labels affixed to a web backer is used, the black mark sensor 16 detects black marks denoting the printing position of each label. The black mark sensor 16 is placed inside a sensor housing unit 55 (see FIG. 2) when the suction unit 5 and platen unit 2 are assembled.

The opening/closing mechanism 20 that opens and closes the suction holes is described next.

Figure 4:
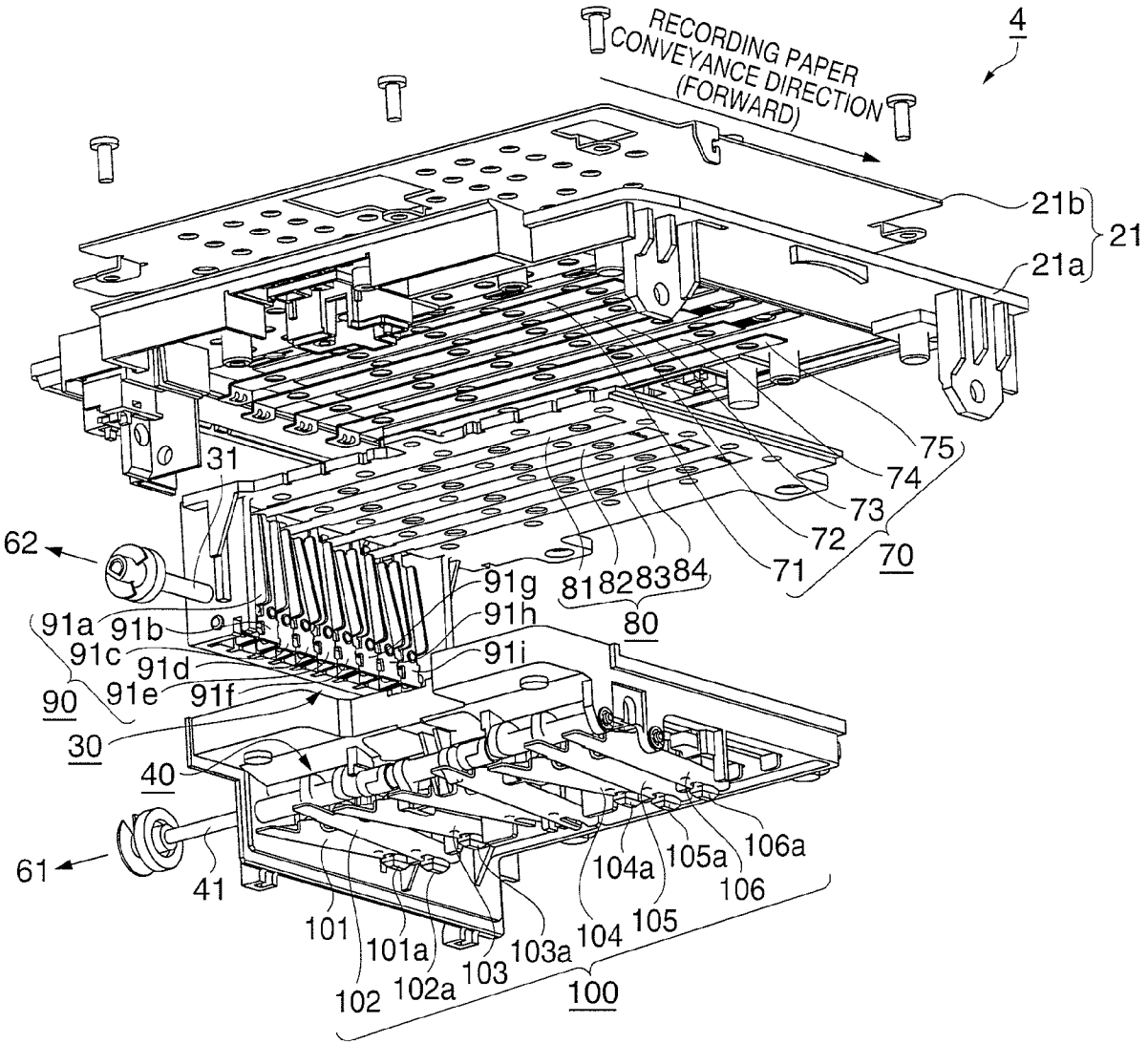
FIG. 4 is an exploded oblique view of the platen mechanism unit.

FIG. 4 is an exploded oblique view of the opening/closing mechanism 20. The opening/closing mechanism 20 includes the first PF shutter plate group 70 located on the bottom of the platen 21, the second PF shutter plate group 80 located on the bottom of the first PF shutter plate group 70, and another PW shutter plate group 100 located below the second PF shutter plate group 80.

The platen 21 includes the platen base 21*a* and a platen top 21*b* fastened to the top of the platen base 21*a*, and the plural suction holes shown in FIG. 3 pass through both the platen base 21*a* and platen top 21*b*.

The first PF shutter plate group 70 is composed of five PF shutter plates 71, 72, 73, 74, 75 disposed parallel to each other with a specific gap therebetween from the upstream side of the conveyance direction perpendicularly to the recording paper conveyance direction. The PF shutter plates 71, 72, 73, 74, 75 can move independently of each other forward and back perpendicularly to the recording paper conveyance direction.

The second PF shutter plate group 80 includes four PF shutter plates 81, 82, 83, 84 disposed parallel to each other with a specific gap therebetween from the upstream side of the conveyance direction perpendicularly to the recording paper conveyance direction. The PF shutter plates 81, 82, 83, 84 are inserted between the PF shutter plates 71, 72, 73, 74, 75 of the first PF shutter plate group 70, and can move forward and back perpendicular to the recording paper conveyance direction.

Opening and closing the suction holes by the first PF shutter plate group 70 and second PF shutter plate group 80 is described next with reference to FIG. 3.

In this embodiment PF shutter plate 71 opens and closes the suction holes in row B1, PF shutter plate 72 opens and closes the suction holes in row B2, PF shutter plate 73 opens and closes the suction holes in row B3, PF shutter plate 74 opens and closes the suction holes in row B4, and PF shutter plate 75 opens and closes the suction holes in row B5.

In addition, PF shutter plate 81 opens and closes the suction holes in row C1, PF shutter plate 82 opens and closes the suction holes in row C2, PF shutter plate 83 opens and closes the suction holes in row C3, and PF shutter plate 84 opens and closes the suction holes in row C4.

The first PF shutter plate group 70 and second PF shutter plate group 80 are driven by operating lever group 90 composed of nine operating levers, and the first cam group 30. The first cam group 30 is turned by a cam shaft 31 connected to the motor 62 of the open/close drive unit 60 (see FIG. 2).

The first cam group 30 includes nine cams not shown. These cams are labelled cam 30*a* to cam 30*i* from the motor-side end of the cam shaft 31. Cam 30*a* causes PF shutter plate 71 to slide by means of operating lever 91*a*, cam 30*b* causes PF shutter plate 81 to slide by means of operating lever 91*b*, cam 30*c* causes PF shutter plate 72 to slide by means of operating lever 91*c*, cam 30*d* causes PF shutter plate 82 to slide by means of operating lever 91*d*, cam 30*e* causes PF shutter plate 73 to slide by means of operating lever 91*e*, cam 30*f* causes PF shutter plate 83 to slide by means of operating lever 91*f*, cam 30*g* causes PF shutter plate 74 to slide by means of operating lever 91*g*, cam 30*h* causes PF shutter plate 84 to slide by means of operating lever 91*h*, cam 30*i* causes PF shutter plate 75 to slide by means of operating lever 91*i* widthwise to the recording paper 15*a* to sequentially open and close the suction holes in the recording paper conveyance direction.

More specifically, when the roll paper 15 is conveyed forward, the alternately disposed first PF shutter plate group 70 and second PF shutter plate group 80 sequentially open the suction holes in lateral rows from B1 to C1, B2, C2, . . . B5, and when the recording paper is reversed, sequentially close the suction holes in lateral rows from row B5 to C4, B4, C3, B3, . . . B1.

Note that the phase difference of cams 30*a* to 30*i* is determined according to the recording paper conveyance speed and distance to sequentially open or close the suction holes in lateral rows in the above order.

The configuration of the PW shutter plate group 100 is described next with reference to FIG. 4 and FIG. 3. The PW shutter plate group 100 is composed of six PW shutter plates 101, 102, 103, 104, 105, 106 parallel to each other widthwise to the recording paper 15*a*. The PW shutter plates 101, 102, 103, 104, 105, 106 can rock to the platen 21 surface independently of each other.

A valve that opens and closes the air chamber (see FIG. 5) is inserted to each PW shutter plate 101 to 106. Valve 101*a* is disposed to PW shutter plate 101, valve 102*a* to PW shutter plate 102, valve 103*a* to PW shutter plate 103, valve 104*a* to PW shutter plate 104, valve 105*a* to PW shutter plate 105, and valve 106*a* to PW shutter plate 106. Opening and closing the air chamber is described with reference to FIG. 5 below.

The PW shutter plate group 100 is driven by the second cam group 40. The second cam group 40 is rotated by a cam shaft 41 connected to the motor 61 of the open/close drive unit 60 (see FIG. 2).

While not described individually below, the second cam group 40 is composed of 6 cams 40*a*, 40*b*, 40*c*, 40*d*, 40*e*, 40*f* from the motor 61 side end, with cam 40*a* rocking PW shutter plate 101, cam 40*b* rocking PW shutter plate 102, cam 40*c* rocking PW shutter plate 103, cam 40*d* rocking PW shutter plate 104, cam 40*e* rocking PW shutter plate 105, and cam 40*f* rocking PW shutter plate 106 to the platen 21.

The arrangement of the PW shutter plate group 100 is described next. PW shutter plate 101 and PW shutter plate 106 are disposed to the opposite outside ends of the 15*a* width, PW shutter plate 102 and PW shutter plate 105 are located to the inside of the paper width therefrom, and PW shutter plate 103 and PW shutter plate 104 are furthest to the inside of the paper width.

The PW shutter plate group 100 works with the first PF shutter plate group 70 and second PF shutter plate group 80 to open and close the suction hole-air chamber-suction hole paths, and the PW shutter plate group 100 handles opening and closing the air chamber-suction hole paths.

The suction hole areas that are opened and closed by the PW shutter plate group 100 are described next with reference to FIG. 3. PW shutter plate 101 opens and closes the suction holes in row A4, PW shutter plate 106 opens and closes the suction holes in row A1, and rows A4 and A1 open and close at the same time.

PW shutter plate 102 opens and closes the suction holes in row A5, PW shutter plate 105 opens and closes the suction holes in row A2, and rows A5 and A2 open and close at the same time.

PW shutter plate 103 opens and closes the suction holes in row A6, PW shutter plate 104 opens and closes the suction holes in row A3, and rows A6 and A3 open and close at the same time.

A separate air chamber is provided for each row A1, A2 A3, A4, A5, A6 of suction holes.

Opening and closing the suction holes by means of the first PF shutter plate group 70, second PF shutter plate group 80, and PW shutter plate group 100 is described next with reference to the figures.

Figure 5:
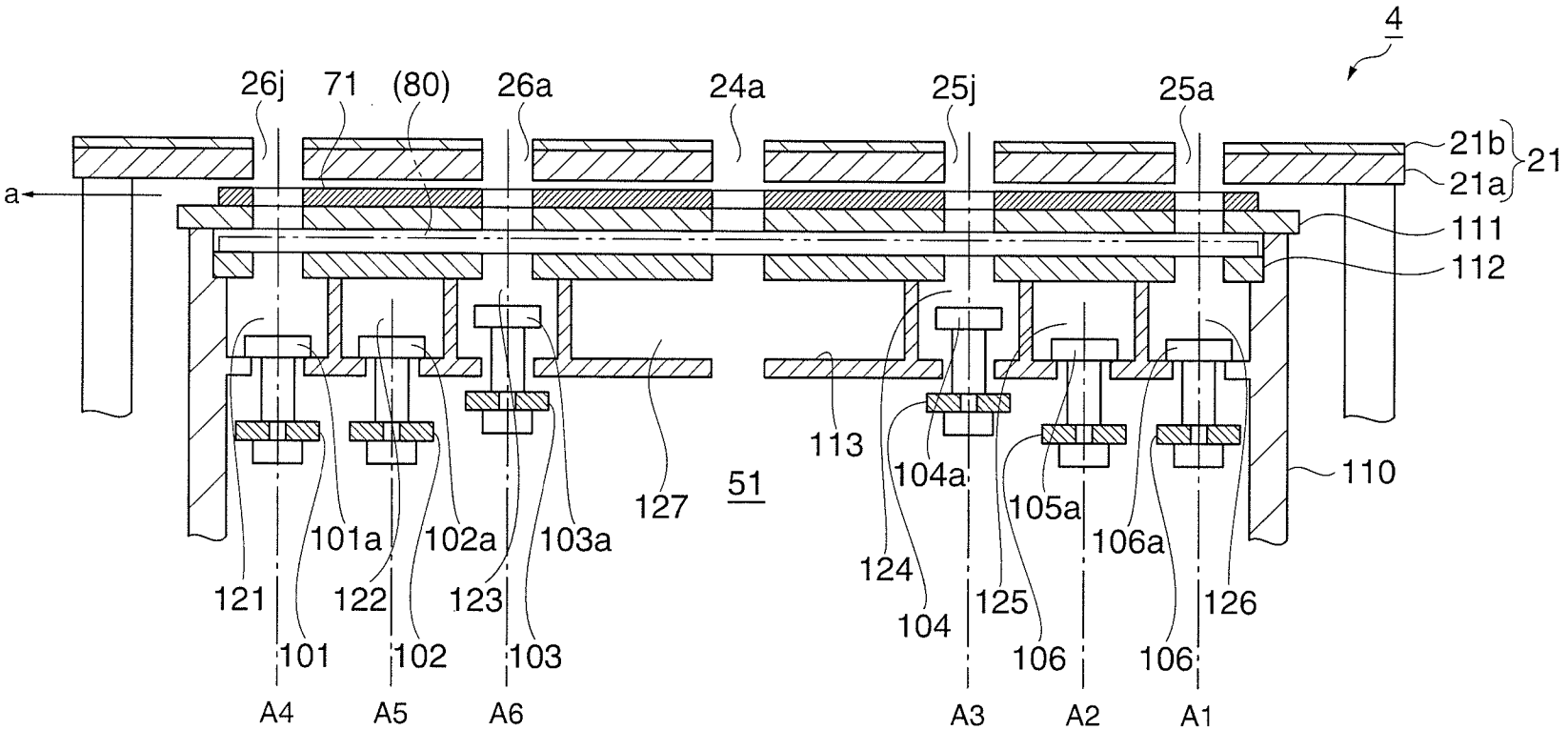
FIG. 5 is a section view describing part of the opening and closing operation of the suction holes.

FIG. 5 is a section view showing the suction hole opening and closing operation in part. FIG. 5 is a section view through line X-X in FIG. 3 through the suction holes in row B1.

As shown in FIG. 5, disposed in layers from top down from the bottom of the platen 21 in which the suction holes for suctioning the recording paper 15*a* are the first PF shutter plate 71, a first shutter plate 111 that supports the PF shutter plate 71 in the thickness direction, the second PF shutter plate group 80 disposed to the bottom of the first shutter plate 111, and a second shutter plate 112 that together with the first shutter plate 111 supports the second PF shutter plate group 80 in the thickness direction. A third shutter plate 113 is further disposed below the second shutter plate 112. The first shutter plate 111, second shutter plate 112, and third shutter plate 113 may be fastened to a shutter holder 110, or formed in unison.

Seven air chambers 121, 122, 123, 124, 125, 126, 127 are formed between the second shutter plate 112 and third shutter plate 113. Paths (through-holes) open to the platen 21 are formed for each suction hole in the first shutter plate 111 and second shutter plate 112.

Air chamber 126 communicates with all suction holes in row A1, air chamber 125 with all suction holes in row A2, air chamber 124 with all suction holes in row A3, and air chamber 127 with all suction holes in the first suction area 24. Air chamber 123 communicates with all suction holes in row A6, air chamber 122 with all suction holes in row A5, and air chamber 121 with all suction holes in row A4.

Valves 101*a* to 106*a* are inserted to the through-holes connecting air chambers 121 to 126 with the suction chamber 51. More specifically, valve 101*a* is disposed to air chamber 121, valve 102*a* to air chamber 122, valve 103*a* to air chamber 123, valve 104*a* to air chamber 124, valve 105*a* to air chamber 125, and valve 106*a* to air chamber 126.

As described above, the valves move up and down by the rocking action of the PW shutter plate, thereby opening and closing the paths between the corresponding air chambers and suction chamber.

A valve is not disposed to the air chamber 127. As a result, opening and closing the suction holes in air chamber 127 and the first suction area 24 is controlled by the first PF shutter plate group 70 and second PF shutter plate group 80.

Because lateral row B1 and longitudinal rows A3 and A6 are shown open in FIG. 5, suction holes 26*a*, 24*a*, 25*j* communicate with suction chamber 51 and can pull the recording paper 15*a* to the platen 21. Sliding PF shutter plate 71 in the direction of arrow a closes the suction holes in row B1.

The first PF shutter plate group 70 and second PF shutter plate group 80 thus open and close the suction holes in lateral rows at the upstream end in the conveyance direction of the recording paper 15*a*, and the PW shutter plate group 100 opens and closes the suction holes in longitudinal rows across the width of the recording paper 15*a*.

Recording Paper Suction Control

Controlling suction of the recording paper 15*a* is described next with reference to the accompanying flow charts and FIG. 1 to FIG. 4.

Suction control before starting printing to the recording paper 15*a* is described first.

Figure 6A:
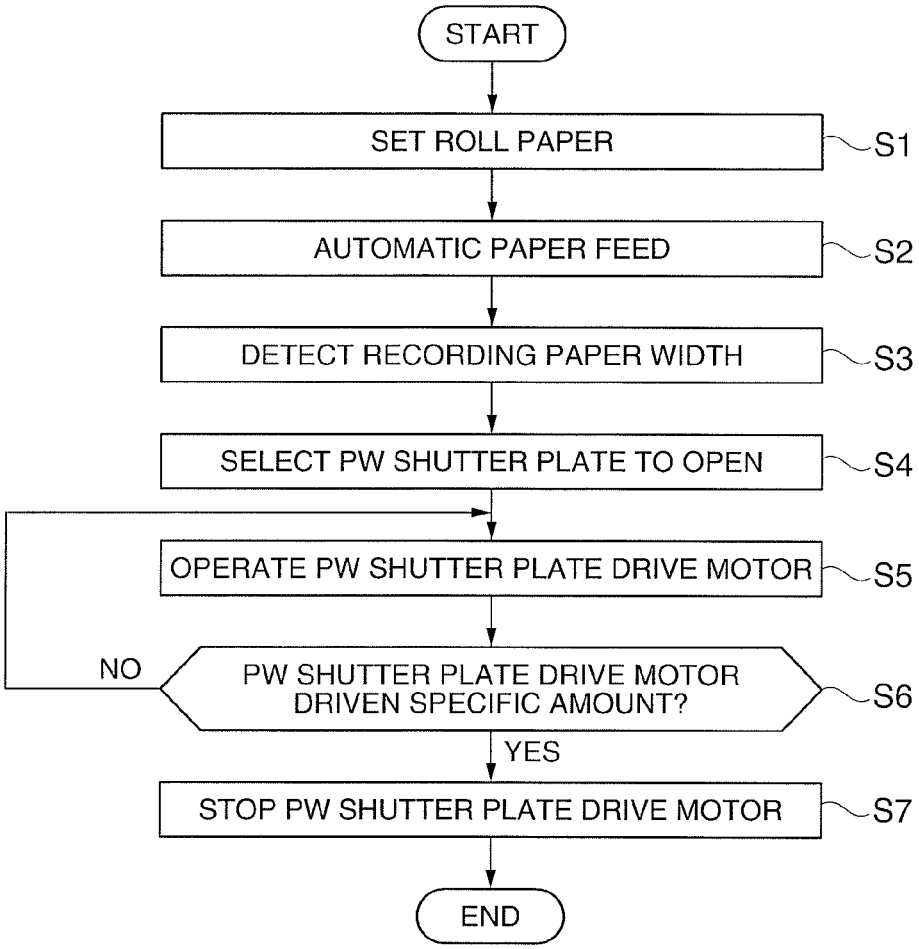
FIG. 6 is a flow chart of steps in determining the suction holes that open and close according to the width of the recording paper, (a) showing the front-feed operation (forward conveyance) and (b) showing the back-feed operation (reverse conveyance).
Figure 6B:
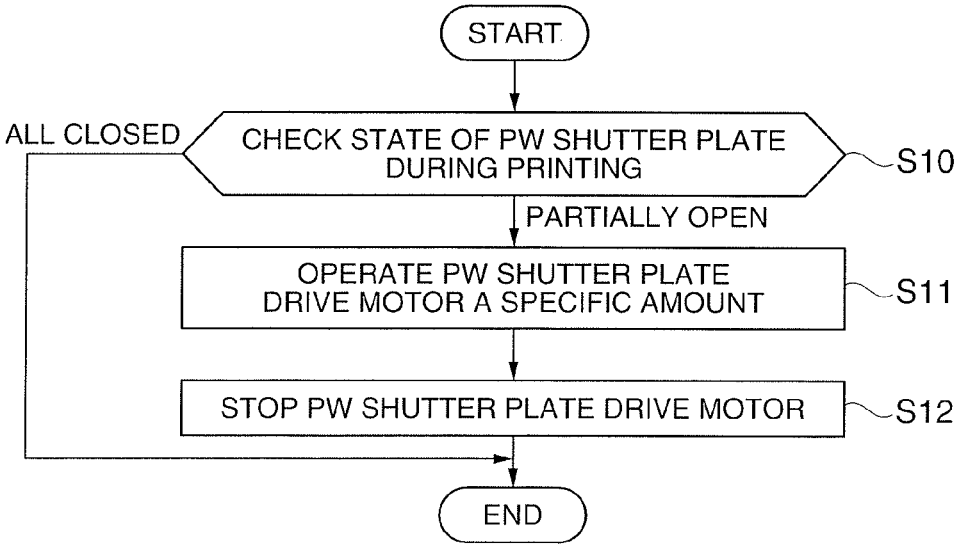

FIG. 6 is a flow chart of the process determining the suction hole areas to be opened or closed according to the width of the recording paper 15*a*, FIG. 6A showing the steps during forward paper feed (forward conveyance) and FIG. 6B showing the steps during back-feeding (reverse conveyance).

Forward paper feed is described first. Operation begins with loading the roll paper 15 onto the roll paper drive shaft 13 in preparation for printing (step S1). Next, the recording paper 15*a* is automatically advanced to the platen 21 surface (step S2).

Next, the width of the recording paper 15*a* is detected with the paper width detection sensor 14 (step S3). This is done by moving the paper width detection sensor 14 across the paper width, detecting the edges of the recording paper 15*a*, and calculating the width.

The PW shutter plates to be opened are then determined according to the paper width (step S4).

For example, if the recording paper 15*a* width is within the first suction area 24, closing all of the PW shutter plates 101 to 106 in the second suction area 25 and third suction area 26 is selected. Note that opening and closing the suction holes in the first suction area 24 is controlled with the first PF shutter plate group 70 and second PF shutter plate group 80.

When the width of the recording paper 15*a* is between longitudinal suction hole rows A2 and A3, and A5 and A6, the recording paper 15*a* covers rows A3 and A6, and the PW shutter plates that open the suction holes in rows A3 and A6 are selected. In this case, PW shutter plates 103 and 104 are selected.

When the width of the recording paper 15*a* is between longitudinal suction hole rows A1 and A2, and A4 and A5, the recording paper 15*a* covers rows A2 and A3, and A5 and A6, and the PW shutter plates that open the suction holes in rows A2 and A3, and A5 and A6 are selected. In this case, PW shutter plates 102, 103, 104, 105 are selected.

When the width of the recording paper 15*a* is outside longitudinal suction hole rows A1 and A4 (when wide paper is loaded), the recording paper 15*a* covers all of the first suction area 24, second suction area 25, and third suction area 26, and the PW shutter plates that open the suction holes in rows A1 to A6 are selected. In this case, PW shutter plates 101, 102, 103, 104, 105, and 106 are selected.

After selecting the PW shutter plates to open, the PW shutter plate drive motor 61 is driven (step S5).

Whether the PW shutter plate drive motor 61 was driven the specified amount is then detected (step S6). More specifically, whether the selected PW shutter plates were driven to the position opening the suction holes to be opened is determined. An encoder disposed to the motor 61, for example, is used to detect the driven amount.

If the motor 61 has not driven the specified amount (No), driving the motor 61 continues. When the specified amount is reached (Yes), the PW shutter plate drive motor 61 stops (step S7), and this operation ends.

Control when the recording paper is reversed to the start printing position after the PW shutter plate opens specific longitudinal rows of suction holes is described next with reference to FIG. 6B.

The positions of the PW shutter plates are checked after the PW shutter plate drive motor 61 is stopped in step S7 in FIG. 6A. More specifically, which suction holes in the PW shutter plate were open while printing is checked.

If the suction holes in all PW shutter plates are closed (all closed), the recording paper 15*a* can be reversed immediately. This means that the suction holes in the second suction area 25 and third suction area 26 are all closed, and the suction holes in the first suction area 24 are open. The suction holes in the first suction area 24 are open during back-feeding regardless of the width of the recording paper 15*a*.

If some of the PW shutter plates are open, the PW shutter plate drive motor 61 is driven a specific amount (step S11). More specifically, all suction holes in the second suction area 25 and third suction area 26 are closed. After confirming the motor 61 has driven the specified amount, driving the PW shutter plate drive motor 61 stops (step S12).

Suction control while printing is described next with reference to the flow chart in FIG. 7 while also referring to FIG. 1 to FIG. 5.

Figure 7:
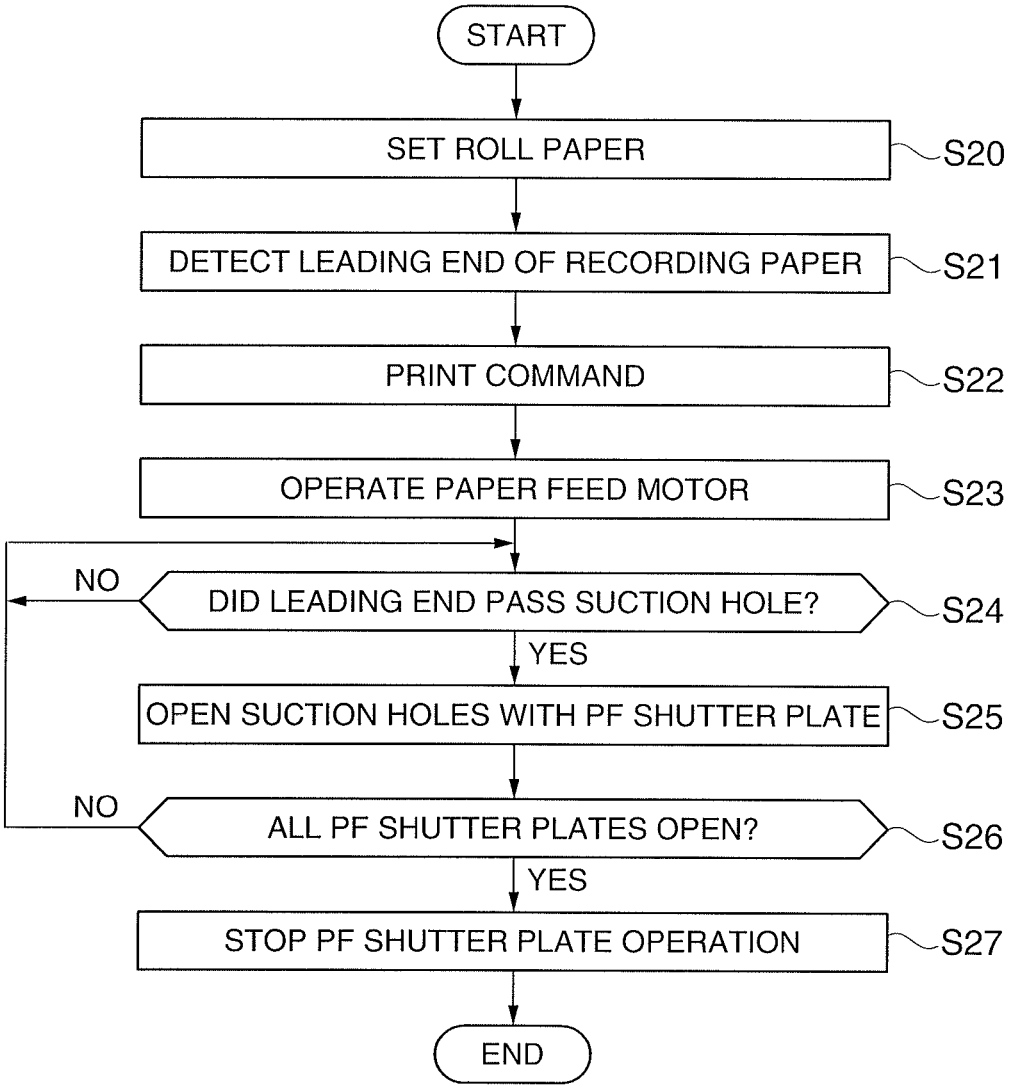
FIG. 7 is a flow chart of in determining the suction holes that open and close according to the recording paper conveyance position during forward conveyance when printing.

FIG. 7 is a flow chart of the process determining the suction hole areas to open and close according to the recording paper conveyance position in the forward direction while printing.

The roll paper 15 is first set on the roll paper drive shaft 13 (step S20). The areas of the open suction holes in the PW shutter plate are previously determined according to the roll paper 15 width in this case. After the roll paper 15 is set, the recording paper 15*a* is automatically fed forward and the leading end is detected with the recording paper position detection sensor 17 (step S21).

After the leading end of the recording paper is detected, a print command is output and printing starts (step S22). Based on this print command, the paper feed motor for driving the paper feed roller 9 is operated to convey the recording paper 15*a* forward while printing with the inkjet head 3 (step S23).

The lateral rows of suction holes passed by the leading end of the recording paper 15*a* is then detected (step S24). The lateral rows of suction holes passed by the recording paper 15*a* are detected from a calculation based on the positions of the suction hole openings, the hole diameter, and the conveyance distance. The positions of the suction hole openings can be calculated from the position of the leading end of the recording paper detected by the recording paper position detection sensor 17 and the design (such as pitch) of the hole openings. The conveyance distance of the recording paper 15*a* is determined using an encoder disposed to the paper feed roller 9 or paper feed motor.

When the leading end of the recording paper 15*a* is detected to pass a specific single lateral row (step S24 returns Yes) and all suction holes in that row are covered by the recording paper 15*a*, the PF shutter plate for opening and closing that row is operated to open the row of suction holes that the leading end of the recording paper 15*a* passed (step S25).

For example, if the recording paper 15*a* passes the suction holes in row B1, PF shutter plate 71 is operated to open suction holes 25*a*, 25*j*, 24*a*, 26*a*, 26*j*. The suction holes in the longitudinal rows not opened by the PW shutter plates at this time are not opened. The suction holes in the lateral rows other than row B1 remain closed. The recording paper 15*a* is then further conveyed and when passing row C1 is detected, PF shutter plate 81 is operated to open the suction holes 25*f*, 24*b*, 24*c*, 26*f* in row C1.

Each time the recording paper 15*a* passes another lateral row of suction holes, the corresponding PF shutter plate is operated and the suction holes in that row are opened.

If step S24 determines that the leading end of the recording paper 15*a* has not passed any suction holes, conveying the recording paper 15*a* continues until a lateral row of suction holes is passed.

If the leading end of the recording paper 15*a* has passed the suction holes in lateral rows B2, C2, to B5 is then detected (step S26). More specifically, if all PF shutter plates are determined to have opened the suction holes in all lateral rows (step S26 returns Yes), operating the PF shutter plates (operating the motor 62) stops (step S27). If some of the PF shutter plates have still not opened the corresponding lateral row of suction holes (step S26 returns No), control returns to step S24 until step S27 executes.

Suction control when the recording paper 15*a* is reversed from the position left in the last step S27 is described next with reference to the flow chart in FIG. 8.

Figure 8:
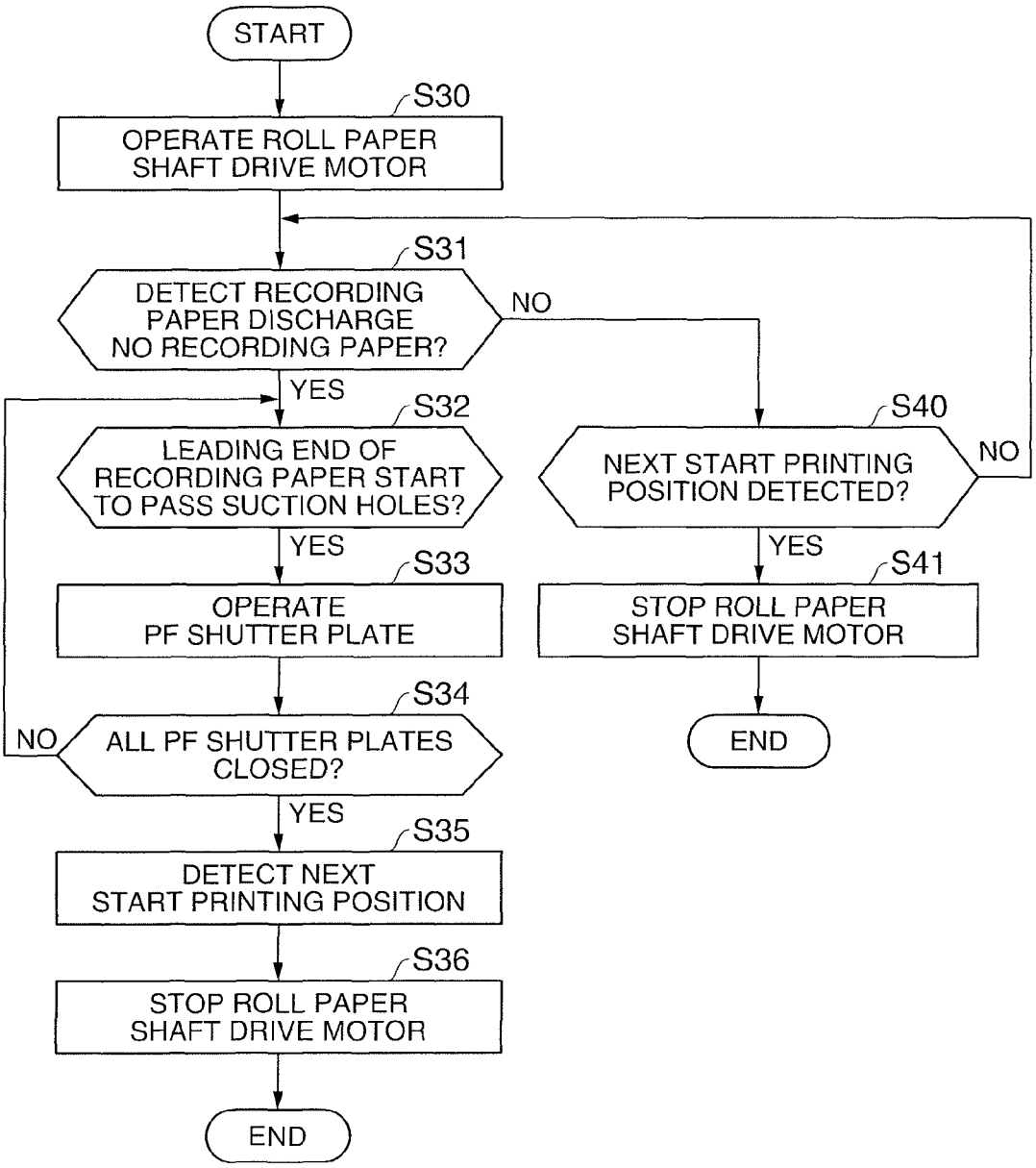
FIG. 8 is a flow chart of steps in determining the suction holes that open and close according to the recording paper conveyance position during reverse conveyance.

FIG. 8 is a flow chart of the process determining suction hole areas that are opened and closed according to the recording paper conveyance position during reverse conveyance. The roll paper shaft drive motor is operated to back feed the paper (step S30).

In this case the leading end position detection unit 18 detects discharge of the recording paper 15*a* (step S31). If the result from the leading end position detection unit 18 is that there is no recording paper 15*a* (step S31 returns Yes), operating the roll paper shaft drive motor continues to back feed the roll paper 15. When the leading end of the paper begins to pass a lateral row of suction holes (step S32), the corresponding PF shutter plate operates to close those holes (step S33). For example, when the leading end of the recording paper begins to pass the suction holes in row B5, PF shutter plate 84 operates and closes the suction holes in row B5. As the leading end of the recording paper is reversed, the PF shutter plates for rows C4, B4 and so forth operate and sequentially close the suction holes in the corresponding lateral rows.

Whether all lateral rows of suction holes have been closed by all PF shutter plates is then detected (step S34). If not all rows have been closed (step S34 returns No), steps S32 to S34 repeat.

If the lateral rows of suction holes have been closed by all of the PF shutter plates (step S34 returns Yes), conveying the recording paper 15*a* continues until the next start printing position is detected (step S35), and operating the roll paper shaft drive motor then stops (step S36).

If recording paper discharge detection by the leading end position detection unit 18 in step S31 determines paper is present (step S31 returns No), the next start printing position is detected (step S40). When the detected position is at the next start printing position (Yes), operating the roll paper shaft drive motor stops (step S41).

If the detected position in step S40 is not the next start printing position (No), reversing the recording paper 15*a* continues until the recording paper 15*a* reaches the next start printing position.

In the printer 1 described above, the suction holes in the area where the recording paper 15*a* covers the suction holes are opened by the first PF shutter plate group 70, second PF shutter plate group 80, and PW shutter plate group 100, and the recording paper 15*a* is pulled to the surface of the platen 21.

In the area where the suction holes are not covered by the recording paper 15*a* (that is, the area where the suction holes are open), suction is not produced by closing the first PF shutter plate group 70, second PF shutter plate group 80, and PW shutter plate group 100.

Because loss of suction pressure is suppressed and sufficient suction pressure can therefore be achieved, a drop in print quality caused by the recording paper lifting up and the platen gap varying can be prevented, and the recording paper rubbing against the liquid ejection head and becoming soiled with ink can be prevented even when using narrow recording paper or stiff recording paper.

Because the suction holes are opened and closed by the first PF shutter plate group 70, second PF shutter plate group 80, and PW shutter plate group 100, and recording paper 15*a* can be suctioned through the suction holes using a single suction unit 5, using a plurality of suction means as described in JP-A-2011-56694, or changing the duty of the suction means is not necessary.

The print area is in the area where the recording paper 15*a* is suctioned, and suction is not produced from the suction holes that are not covered by the print area of the recording paper. As a result, dispersion of the liquid droplets is reduced, and print quality can be maintained. This also has the effect of enabling reducing the margin required at the sides of the recording paper 15*a* width.

Furthermore, by selecting the longitudinal rows of suction holes that are opened and closed according to the recording paper 15*a* width with the PW shutter plate group 100, the suction holes in the first suction area 24 or rows A3 and A6 on opposite sides thereof can be opened when using narrow recording paper, the suction holes in all longitudinal rows can be opened when using wide recording paper, and suction can be adjusted according to the recording paper 15*a* width.

The suction holes in lateral rows covered by the recording paper 15*a* can also be opened according to the recording paper 15*a* conveyance position (in both forward and reverse directions) by the first PF shutter plate group 70 and second PF shutter plate group 80, and the recording paper 15*a* can be suctioned desirably.

The PW shutter plate group 100 has valves 101*a* to 106*a* that open and close a third shutter plate divided into air chambers 121 to 126 provided for each of the longitudinal rows of suction holes and a suction chamber 51. This enables efficiently controlling the suction areas in longitudinal rows across the width of the recording paper.

By disposing the first PF shutter plate group 70 and second PF shutter plate group 80 in two layers at different positions in section, and alternately interleaving the PF shutter plates of the first PF shutter plate group 70 and second PF shutter plate group 80, good operability, the hole diameter necessary to provide suction, and the rigidity of the PF shutter plate can be assured even when the pitch between the lateral rows of suction holes is small.

Furthermore, because the width of the recording paper 15*a* is measured with a paper width detection sensor 14 when the recording paper 15*a* travels over the surface of the platen 21, and the longitudinal rows of suction holes that are opened and closed are determined according to the detected width, the size of the suction area across the paper width (the longitudinal rows) can be easily determined even when the width of the recording paper changes.

The lateral rows of suction holes that are opened and closed by the PF shutter plates can be calculated using the conveyance speed and conveyance distance of the recording paper 15*a*, and the pitch between the suction holes in the conveyance direction, the row at the position where the leading end of the recording paper 15*a* covers the suction holes opened, and the row at the position passed by the leading end of the recording paper 15*a* closed. The position of the leading end of the recording paper 15*a* to the suction holes can therefore be accurately determined, and the suction holes can be opened and closed at the appropriate times. A sensor or other detection means for detecting the position of the leading end of the recording paper 15*a* while being conveyed is also not necessary.

The lateral rows of suction holes that are opened and closed by the PF shutter plate groups 70 and 80 can also be calculated using the conveyance speed and conveyance distance of the recording paper and the pitch between the suction holes in the conveyance direction, the row at the position where the suction holes are covered by the leading end of the recording paper 15*a* opened, and the row at the position where the leading end of the recording paper 15*a* begins to pass the suction holes closed. The position of the recording paper 15*a* to the suction holes can therefore be accurately determined, and the suction holes can be opened and closed at the appropriate times. A sensor or other detection means for detecting the position of the leading end of the recording paper 15*a* while being conveyed is also not necessary.

The individual PF shutter plates of the first PF shutter plate group 70 and second PF shutter plate group 80 are driven by a first cam group 30 with the cam phase synchronized to the open and close timing of the lateral rows of suction holes and the recording paper 15*a* conveyance speed. Speed control of the conveyance speed and cam group drive is simple when separate drive motors are used for each. Because the phase of the first cam group 30 can therefore be structurally fixed, the open/close timing of the suction holes can also be controlled effectively with high precision.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No: 2011-181292, filed Aug. 23, 2011 is expressly incorporated by reference herein.

What is claimed is:

1. A printing device comprising:

a liquid droplet ejection head that ejects liquid droplets;

a conveyance unit that conveys recording paper;

a platen that is disposed opposite the liquid droplet ejection head and has a plurality of suction holes arrayed in a conveyance direction in which the conveyance unit conveys the recording paper and a lateral direction perpendicular to the conveyance direction;

a suction mechanism unit that suctions the recording paper through the suction holes in the platen; and an opening/closing mechanism that opens or closes at least part of the plural suction holes wherein:

the opening/closing mechanism includes a first opening/closing unit that opens or closes the suction holes disposed on one side of the lateral direction in the plural suction holes, a second opening/closing unit that opens or closes the suction holes disposed on one side of the conveyance direction in the plural suction holes, the first opening/closing unit is configured to move in a first direction to open or close respective suction holes, and the second opening/closing unit is configured to move in a second direction different from the first direction to open or close the respective suction holes.

2. The printing device described in claim 1, wherein:

the opening/closing mechanism opens the suction holes disposed at a position covered by the recording paper, and closes the suction holes disposed at a position not covered by the recording paper.

3. The printing device described in claim 1, wherein:

the opening/closing mechanism opens the suction holes when the recording paper is conveyed by the conveyance unit and the suction holes are covered by the recording paper, and closes the suction holes when the recording paper is conveyed by the conveyance unit and the suction holes are no longer covered by the recording paper.

4. The printing device described in claim 1, further comprising:

an air chamber that communicates with a plurality of suction holes disposed in the conveyance direction;

a path that connects the air chamber and the suction mechanism unit; and a valve that is disposed to and opens and closes the path.

5. The printing device described in claim 1, wherein:

the second opening/closing unit opens or closes the suction holes based on the conveyance position of the recording paper by the conveyance unit.

6. The printing device described in claim 1, wherein:

the second opening/closing unit opens or closes the suction holes on the opposite side as the one side in the conveyance direction in the plural suction holes.

7. The printing device described in claim 6, wherein:

the second opening/closing unit has a first shutter plate that opens or closes suction holes disposed on one side in the conveyance direction, and a second shutter plate that opens or closes suction holes disposed on the other side in the conveyance direction.

8. The printing device described in claim 1, further comprising:

a paper width detection unit that detects the width of the recording paper;

wherein the first opening/closing unit opens or closes the suction holes based on the paper width detected by the paper width detection unit.

9. The printing device described in claim 1, wherein:

the first opening/closing unit opens or closes the suction holes on one side and the opposite other side of the paper width in the plural suction holes.

10. The printing device described in claim 1, wherein:

the second opening/closing unit opens or closes the suction holes based on a result calculated using a conveyance speed of the recording paper by the conveyance unit and a distance between the plural suction holes in the recording paper conveyance direction.

11. The printing device described in claim 7, further comprising:

a cam that drives the first shutter plate and the second shutter plate.

12. The printing device described in claim 11, wherein:

the cam phase is synchronized to the preset open or close timing of the suction holes.

13. A recording paper conveyance mechanism comprising:

a platen that is disposed opposite a liquid droplet ejection head and has a plurality of suction holes arrayed in a conveyance direction of recording paper and a lateral direction perpendicular to the conveyance direction;

a suction mechanism unit that suctions the recording paper through the suction holes in the platen; and an opening/closing mechanism that opens or closes at least part of the plural suction holes wherein:

the opening/closing mechanism includes a first opening/closing unit that opens or closes the suction holes disposed on one side of the lateral direction in the plural suction holes, and a second opening/closing unit that opens or closes the suction holes disposed on one side of the conveyance direction in the plural suction holes.

14. The recording paper conveyance mechanism described in claim 13, wherein:

the opening/closing mechanism opens the suction holes disposed at a position covered by the recording paper, and closes the suction holes disposed at a position not covered by the recording paper.

15. The recording paper conveyance mechanism described in claim 13, wherein:

the opening/closing mechanism opens the suction holes when the recording paper is conveyed by the conveyance unit and the suction holes are covered by the recording paper, and closes the suction holes when the recording paper is conveyed by the conveyance unit and the suction holes are no longer covered by the recording paper.

16. The printing device described in claim 1, wherein:

the first opening/closing unit is separate from the second opening and closing unit.

17. The printing device described in claim 1, wherein:

the first direction is at least generally parallel to the conveyance direction; and the second direction is at least generally perpendicular to the conveyance direction.

18. The printing device described in claim 1, wherein:

the first opening/closing unit is configured to move only along the first direction; and the second opening/closing unit is configured to move only along the second direction.

19. The printing device described in claim 1, wherein:

with respect to the printing device being oriented for use with the conveying direction being normal to a direction of gravity, the first direction is at least generally horizontal and the second direction is at least generally vertical.

20. The printing device described in claim 1, wherein:

the printing device is configured such that the first opening/closing unit moves to open or close respective suction holes while the second opening/closing unit is stationary.

21. The printing device described in claim 20, wherein:

the printing device is configured such that the second opening/closing unit moves to open or close respective suction holes while the first opening/closing unit is stationary.

22. The recording paper conveyance mechanism described in claim 13, wherein:

the first opening/closing unit is configured to move in a first direction to open or close respective suction holes, and the second opening/closing unit is configured to move in a second direction different from the first direction to open or close the respective suction holes.

* * * * *